US007426772B2

(12) United States Patent
Himi et al.

(10) Patent No.: US 7,426,772 B2
(45) Date of Patent: Sep. 23, 2008

(54) FASTENER ELEMENT AND CONCEALED SLIDE FASTENER

(75) Inventors: Naoyuki Himi, Toyama-ken (JP); Masayoshi Kojima, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 11/633,736

(22) Filed: Dec. 5, 2006

(65) Prior Publication Data

US 2007/0124900 A1 Jun. 7, 2007

(30) Foreign Application Priority Data

Dec. 6, 2005 (JP) ..... 2005-351434

(51) Int. Cl.
*A44B 19/06* (2006.01)

(52) U.S. Cl. ..... 24/414; 24/432

(58) Field of Classification Search ..... 24/384, 24/389, 432, 408–414
See application file for complete search history.

(56) References Cited

U.S. PATENT DOCUMENTS 2,849,774 A * 9/1958 Ryser ..... 24/412
3,153,830 A * 10/1964 Morin ..... 24/413
2005/0217086 A1* 10/2005 Kusayama et al. ..... 24/389

FOREIGN PATENT DOCUMENTS

JP UM-52-10483 3/1977
JP UM-2598345 6/1999

* cited by examiner

*Primary Examiner*—James R Brittain
(74) *Attorney, Agent, or Firm*—Alston & Bird LLP

(57) ABSTRACT

A fastener element for a concealed type slide fastener having a substantially U shaped section including a side edge portion mounting groove for a fastener tape, comprising: a C shaped base portion; flat first and second tape nipping portions extended substantially in parallel from respective front ends of the C shaped base portion; and a coupling portion integrated with an engaging face side on the opposite side to a tape nipping face of the second tape nipping portion, wherein the first tape nipping portion has expanded portions expanded back and forth in a coupling direction, and a front end face of the first tape nipping portion is formed wider than a front end face of the second tape nipping portion, thereby having excellent concealed property and coupling strength and capable of preventing generation of a gap between right and left fastener tapes even if pulling stress is applied.

7 Claims, 8 Drawing Sheets

FASTENER ELEMENT AND CONCEALED SLIDE FASTENER

BACKGROUND OF THE INVENTION

1. Field of the Invention

The present invention relates to a fastener element for a concealed type slide fastener in which coupled elements are not seen from a tape surface when the fastener elements (hereinafter, sometimes abbreviated as just element) attached along a side edge of each of a pair of fastener tapes are coupled with each other, and to a concealed type slide fastener in which the same elements are arranged in line on element attaching edge portions of the fastener tapes.

2. Description of the Related Art

Conventionally, fastener elements (hereinafter sometimes abbreviated as just element) for using in this kind of concealed type slide fastener are mounted along element attaching edge portions each including a core thread portion at a side edge of a fastener tape by injection molding of synthetic resin or die-casting of zinc alloy or the like.

The element for using in this concealed type slide fastener has a substantially U shaped axial section, and is mounted such that a coupling portion of the element is directed toward the inside of the fastener tape. Alternatively, a concealed type slide fastener is constituted by inserting a slider into an element row in a state, in which the element attaching edges of the fastener tape attached with the elements are folded back into a letter U shape.

However, if a pulling stress is applied to such a concealed type slide fastener in a tape width direction from both sides of the fastener tape when the elements are coupled with each other, a gap is generated between right and left fastener tapes so that coupled elements are seen from the tape surface, thereby not securing concealed property. Further, there is another problem that since the sliding operation of the slider is heavy, it makes difficult to operate the slider smoothly when the concealed type slide fastener is opened/closed.

To solve the above-described problem, for example, Japanese Utility Model Publication No. 52-10483 has disclosed a concealed type slide fastener element having the following configuration. That is, a coupling portion is provided on one end of a tape fixing portion of an element having a U shaped section such that shape of the upper and lower portions of the coupling portion are symmetrically different, and symmetrical engaging faces in the right and left direction are formed on a border between the upper and lower portions, while a projecting portion is provided projectingly on the other end of the tape fixing portion.

The concealed type slide fastener provided with the elements described in the Japanese Utility Model Publication No. 52-10483 can ensure a stable coupled state without any displacement because the vertical motion of the element is blocked by the engaging face when right and left elements are coupled by sliding the slider. As a consequence, the element can be prevented from rotating even if a tension is applied in the tape width direction so as to block generation of a gap between the right and left fastener tapes.

According to the Japanese Utility Model Publication No. 52-10483, a gap is generated between the fixing portion of the element and the fastener tape by providing the projecting portion on the other end of the tape fixing portion, thereby making it possible to allow the slider to slide lightly and prevent the tape from being damaged.

The Japanese Utility Model Publication No. 2598345 has disclosed the following concealed type slide fastener element. That is, the element described in the Japanese Utility Model Publication No. 2598345 is an element having a substantially U shaped axial section in which a tape mounting groove is formed. Upper and lower portions of a coupling portion located at one end have different shapes while an engaging face is formed on a border between the both. A vertical wall face is formed at the front end of the upper portion, and the thickness of the lower portion is set to be half of that of the element main body. Further, the tape mounting groove is formed obliquely, and a connecting portion for connecting one end side of the element with the other end side is provided on part of the tape mounting groove. Moreover, a slider guide piece is provided projectingly at the front end of the other end of the element to improve the sliding performance of the slider.

The Japanese Utility Model Publication No. 2598345 has described an effect that the right and left elements can be coupled securely and a vertical displacement can be restricted sufficiently by using such an element in the concealed type slide fastener. In addition, the document has described that if a fastener chain is bent to the fastener tape side in the longitudinal direction, it can be bent very easily without being stiffened like the conventional product.

Furthermore, the Japanese Utility Model Publication No. 2598345 has said that horizontal pulling force and coupling strength of the slide fastener can be raised because the tape mounting groove is formed obliquely and the coupling portion is provided in part thereof, and that the other end portion of the element can be formed thinly so as to finish the element itself into a thin and beautiful configuration.

In recent years, the concealed type slide fastener has been widely applied to a variety of products such as clothes or automobile passenger seat covers by taking an advantage that the slide fastener does not lower the design performance of such a product because it has concealed property which conceals elements. For this reason, the concealed type slide fastener has been demanded to have a high performance which is capable of securing the concealed property and coupling strength even if the slide fastener is used under various environments or conditions.

More specifically, when the concealed type slide fastener is applied to the seat cover of automobile or the like, a pulling stress which pulls fastener stringers from both sides is applied to the concealed type slide fastener when the fastener elements are going to be coupled with each other or the slide fastener is in a coupled state, because the seat cover is formed in a smaller size than the external dimensions of a cushion body. However, when the strong pulling stress is applied to the concealed type slide fastener attached with the conventional elements as described in the Japanese Utility Model Publication No. 52-10483 and the Japanese Utility Model Publication No. 2598345, there likely occurs such a fault as generation of a gap between the right and left fastener tapes, and release of coupling of elements.

Further, such a conventional concealed type slide fastener is weak against a twisting force or a pushing force. For example, if the concealed type slide fastener sewed on clothes receives a twisting force or a pushing force, coupling portions of the elements are easy to be deformed or damaged so that the slide fastener cannot bear a long term use.

In the element of the Japanese Utility Model Publication No. 52-10483, both the upper and lower portions of the coupling portion are formed up to the front ends. When right and left elements are coupled, the side ends of the upper and lower portions of the coupling portion of one element are fitted to the side ends of the upper and lower portions of an adjoining coupling portion. As a consequence, when bending the fastener chain, its bending operation cannot be carried out smoothly because the fastener chain has stiffness and is lack of plasticity.

On the other hand, although the element of the Japanese Utility Model Publication No. 2598345 can be bent easily as described above, the coupling head and neck portion are easy to be deformed or damaged because the coupling head is provided protrudedly from the base portion (main body) of the element through a constricted neck portion.

The present invention has been achieved in views of the above-described problems, and an object of the invention is to provide a fastener element for a concealed type slide fastener, having an excellent concealed property and coupling strength and capable of preventing generation of a gap between right and left fastener tapes even if pulling stress is received and generation of deformation and damage even if twisting force or pushing force is received, and to provide a concealed type slide fastener equipped with the fastener elements.

SUMMARY OF THE INVENTION

In order to achieve the above-described object, according to an aspect of the present invention, there is provided a fastener element for a concealed type slide fastener having a substantially U shaped section including a side edge portion mounting groove for a fastener tape, being characterized by comprising: a C shaped base portion for holding a core thread portion; first and second tape nipping portions which are flat and extended substantially in parallel from respective front ends of the C shaped base portion; and a coupling portion integrated with an engaging face side on an opposite side to a tape nipping face of the second tape nipping portion, wherein the first tape nipping portion has expanded portions which are expanded back and forth in a coupling direction, and a front end face of the first tape nipping portion is formed wider than a front end face of the second tape nipping portion.

In the fastener element having the substantially U shaped section according to the invention, the first and second tape nipping portions are extended substantially in parallel from respective front ends of the C shaped base portion, the first tape nipping portion has expanded portions which are expanded back and forth in the coupling direction, and the front end face of the first tape nipping portion is formed wider than the front end face of the second tape nipping portion. As a result, when right and left elements of the concealed type slide fastener produced with this fastener element are coupled, the fastener tape can be pressed stably by the right and left elements from the both side because the front end face of the first tape nipping portion is formed wider than a conventional type so as to increase the area for pressing the fastener tape between the right and left elements. Accordingly, even if the concealed type slide fastener receives pulling stress, generation of a gap between the fastener tapes can be prevented effectively so as to largely intensify the concealed property of the concealed type slide fastener.

Even if a load is applied to the second tape nipping portion when twisting force or pushing force is applied to the concealed type slide fastener produced using the elements of the present invention, the first wide tape nipping portion can receive the load to support the second tape nipping portion because the first tape nipping portion is formed widly having the expanded portions. As a consequence, generation of deformation and damage in the second tape nipping portion can be prevented to provide an excellent quality concealed type slide fastener capable of bearing a long term use.

In the meantime, the coupling direction mentioned in the present invention refers to the longitudinal direction of the fastener tape when the elements are mounted to the fastener tape. The vertical direction of the element refers to a direction from the front surface to the rear surface of the element when right and left elements are coupled (see FIG. 1).

Further, in order to achieve the above-described object, according to an aspect of the present invention, there is provided a fastener element for a concealed type slide fastener having a substantially U shaped section including a side edge portion mounting groove for a fastener tape, being characterized by comprising: a C shaped base portion for holding a core thread portion; first and second tape nipping portions which are flat and extended substantially in parallel from respective front ends of the C shaped base portion; and a coupling portion integrated with an engaging face side on an opposite side to a tape nipping face of the second tape nipping portion, wherein the engaging face of the second tape nipping portion is formed in a tapered face which is tilted upward from a proximal portion side of the engaging face toward a front end side thereof with respect to a top face of a coupling head of the coupling portion.

Consequently, when the right and left elements are coupled by sliding the slider, the coupling head can be pressed downward and introduced appropriately by allowing the coupling head of a mating element to slide on the tilted engaging face of the element. As a result, force of urging the elements can be exerted in a direction of fitting fastener tapes to each other. Thus, by the above described effect, if the right and left fastener tapes receive the pulling stress when the elements are coupled, generation of a gap between the tapes can be prevented to intensify the concealed property of the concealed type slide fastener because the fastener tapes can be fitted to each other stably. Further, at a time of closing the concealed type slide fastener, the slider can be slid smoothly, thereby achieving improvement of the sliding performance.

Further, in order to achieve the above-described object, according to an aspect of the present invention, there is provided a fastener element for a concealed type slide fastener having a substantially U shaped section including a side edge portion mounting groove for a fastener tape, being characterized by comprising: a C shaped base portion for holding a core thread portion; first and second tape nipping portions which are flat and extended substantially in parallel from respective front ends of the C shaped base portion; and a coupling portion integrated with an engaging face side on an opposite side to a tape nipping face of the second tape nipping portion, and further characterized by comprising a reinforcing portion for connecting a front end face of the second tape nipping portion with a top face of the coupling head of the coupling portion.

The fastener element according to still another aspect of the invention further comprises the reinforcing portion which connects the front end face of the second tape nipping portion with the top face of the coupling head of the coupling portion. For example, in the case where the front end face of the second tape nipping portion intersects with the coupling head top face at right angle, and the coupling head is provided via the shoulder portion and the constricted neck portion from the C shaped base portion, there is a fear that the coupling portion may be deformed or damaged when it receives the strong twisting force, the pushing force or the like. However, by providing the reinforcing portion as mentioned in the present invention, the strength of the coupling portion can be secured sufficiently so as to prevent the coupling portion from being deformed or damaged. As a consequence, even if the strong twisting force or the pushing force is received when the elements are coupled, the fitting state of the fastener tapes can be maintained stably, thereby preventing generation of a gap between the tapes to largely intensify the concealed property of the concealed type slide fastener. Further, stable use of the concealed slide fastener for a long period is made possible.

Preferably, a thickness of the reinforcing portion in a vertical direction decreases gradually as it goes from the front end face of the second tape nipping portion to a front end portion of the coupling head.

As a consequence, when the elements attached to the fastener tapes are coupled, the reinforcing portion can be prevented from biting into the fastener tape on a mating element side. Alternatively, even if the reinforcing portion makes contact with the fastener tape, it can be blocked from biting into the fastener tape excessively, thereby avoiding an interference between the reinforcing portion and the fastener tape.

Preferably, a width of the reinforcing portion in a coupling direction decreases gradually as it goes from the front end face of the second tape nipping portion to a front end portion of the coupling head and/or the second tape nipping portion has a cutout in a shoulder mouth side at a front end of each of both edge portions back and forth in the coupling direction.

In this case, the width of the reinforcing portion in the coupling direction is decreased gradually as it goes from the front end face of the second tape nipping portion to the front end portion of the coupling head, or a cutout is provided in the shoulder mouth side at the front end of each of both edge portions back and forth in the coupling direction of the second tape nipping portion. For example, when the coupling heads of the elements are coupled, the coupling head top face of the element opposes the engaging face of the second tape nipping portion of a mating element. By decreasing the width of the reinforcing portion gradually as described above or providing the cutouts in the shoulder mouth side at the front ends of the second tape nipping portion, the reinforcing portion provided on the coupling head top face of the element can be prevented from making contact with the engaging face of the second tape nipping portion of a mating element, whereby it becomes possible to avoid an interference between the reinforcing portion and the second tape nipping portion. As a consequence, when the elements are coupled, a state in which the coupling head top face of the element opposes the engaging face of the mating element can be secured so as to obtain excellent coupling strength.

Preferably, a first outer peripheral face of a first bent portion which is bent from an upper portion to a side portion of the C shaped base portion and a second outer peripheral face of a second bent portion which is bent from the side portion to a lower portion form a curved surface, and the second outer peripheral face has a larger curvature radius than that of the first outer peripheral face.

In the element of the present invention, a first outer peripheral face of a first bent portion which is bent from the upper portion to the side portion of the C shaped base portion and a second outer peripheral face of a second bent portion which is bent from the side portion to the lower portion form a curved surface formed to be R-shaped. As a consequence, when opening/closing the concealed type slide fastener by sliding the slider, the sliding performance of the slider can be improved further by suppressing an interference between the element and the slider. Moreover, when elements are passed through the inside of the slider, the elements can be rotated within the slider so as to turn the posture of the elements into a posture suitable for coupling, thereby coupling the right and left elements more securely. Particularly, according to the present invention, the second outer peripheral face has a larger curvature radius than the first outer peripheral face. As a result, when the elements are rotated within the inside of the slider to a suitable posture, the elements can be rotated very smoothly, so that the posture of the element can be tilted efficiently to a suitable posture.

According to still another aspect of the present invention, there is provided a concealed type slide fastener, being characterized in that a plurality of the fastener elements are arranged in line at a predetermined interval along element attaching edge portions of a pair of fastener tapes, and a slider is inserted into the fastener elements with each of the fastener tapes on an element attaching edge portion side folded back into a substantially letter U shape.

Since the elements having the above-described feature are mounted on the element attaching edge portion of the fastener tape, the concealed slide fastener of the present invention has the excellent concealed property and the coupling strength and can prevent generation of a gap between the right and left fastener tapes even if the pulling stress is applied or can prevent generation of deformation or damage in the coupling portion even if the twisting force, the pushing force or the like is applied. Additionally, the concealed type slide fastener of the present invention ensures an excellent sliding performance. The effects which the present invention exerts are considerably great.

DESCRIPTION OF THE PREFERRED EMBODIMENTS

Figure 1:
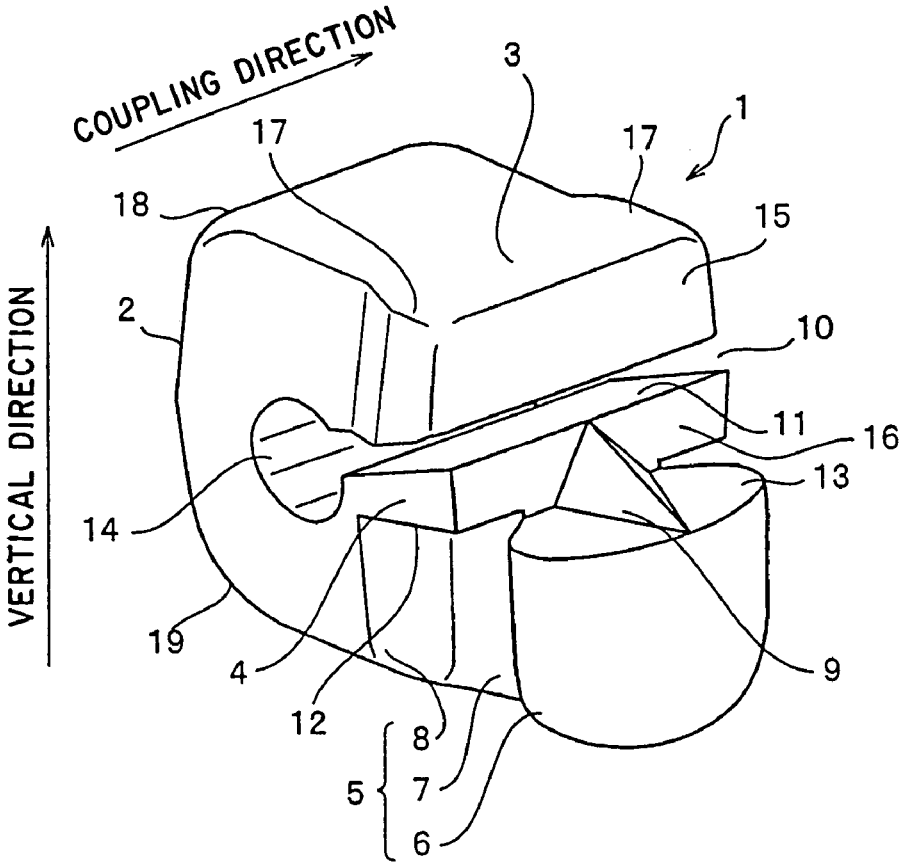
FIG. 1 is a perspective view showing a fastener element of the present invention.
Figure 2:
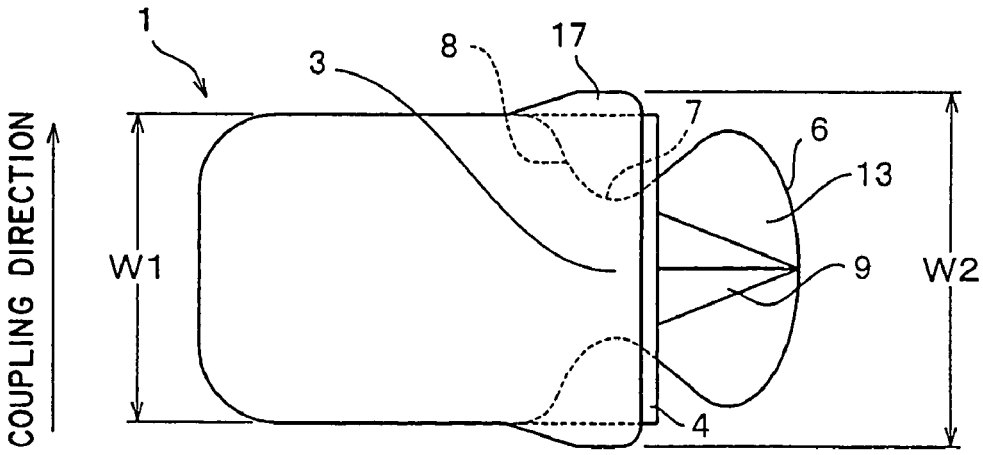
FIG. 2 is a front view of the fastener element of the invention.
Figure 3:
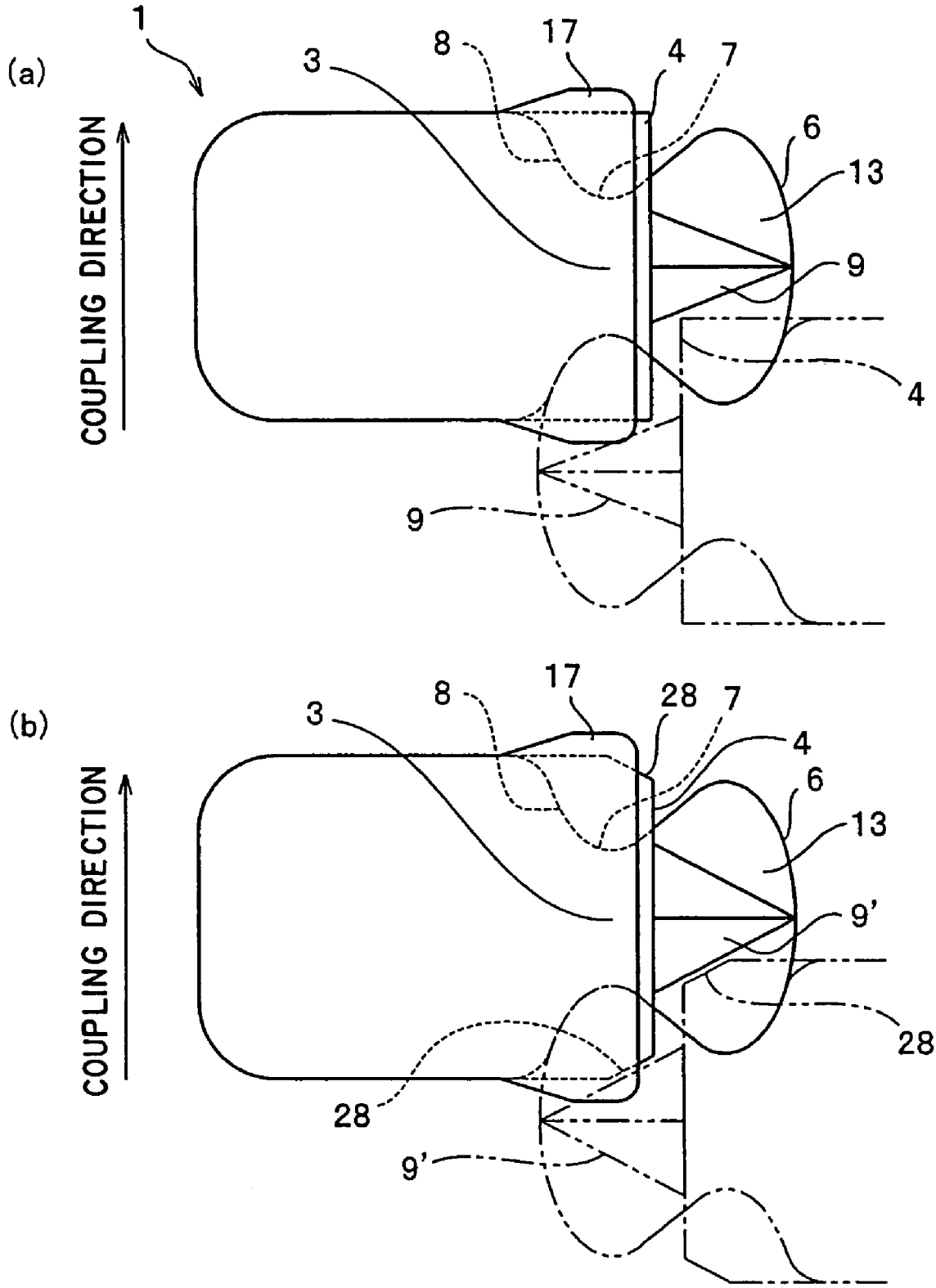
FIG. 3A is a front view showing a state in which the fastener elements of the invention are coupled with each other.
FIG. 3B is a front view showing a state in which fastener elements according to another embodiment of the invention are coupled with each other.

Hereinafter, preferred embodiments of the present invention will be described in detail with reference to the accompanying drawings. FIG. 1 is a perspective view showing an entire fastener element according to one embodiment of the present invention. FIG. 2 is a front view of the fastener element. FIG. 3A is a front view showing a state in which the fastener elements are coupled with each other, indicating a position of a mating fastener element with a phantom line when the fastener elements are coupled with each other.

EMBODIMENT

The fastener element 1 shown in FIG. 1 has a substantially U shaped axial section, wherein a tape side edge mounting groove 10 for a fastener tape 22 is formed, and is comprised of a C shaped base portion 2 for holding a core thread portion 25 of the fastener tape 22, a first flat tape nipping portion 3 and a second flat tape nipping portion 4, which extend substantially in parallel from respective ends of the C shaped base portion 2, and a coupling portion 5 integrated with an engaging face 12 on the opposite side to a tape nipping face 11 of the second tape nipping portion 4. The front end of the second tape nipping portion 4 is constructed to project slightly more forwardly compared to the front end of the first tape nipping portion 3.

In the fastener element 1 of this embodiment, a circular holding groove 14 for holding the core thread portion 25 is provided substantially in the center in the vertical direction of the C shaped base portion 2 and a tape side edge mounting groove 10 is formed obliquely upward from the circular holding groove 14. In the meantime, a connecting portion for connecting the first tape nipping portion 3 with the second tape nipping portion 4 as described in the aforementioned Japanese Utility Model Publication No. 2598345 may be provided substantially in the center of the tape side edge mounting groove 10 although not shown in this embodiment. The fastener element 1 can be fixed firmly to a predetermined position of the fastener tape 22 by providing such a connecting portion.

The coupling portion 5 integrated with the engaging face 12 side of the second tape nipping portion 4 has an oval coupling head 6, a constricted neck portion 7, and a shoulder portion 8 provided continuously from the C shaped base portion 2. In this case, the engaging face 12 extends from the shoulder portion 8 toward the coupling head 6 on both the right and left sides of the neck portion 7 and the shoulder portion 8. Both the right and left side edge portions (that is, both edge portions back and front in a coupling direction) of the second tape nipping portion 4 are stretched like a peak with respect to the neck portion 7 and the shoulder portion 8. Thus, when the coupling head 6 is coupled with a mating element 1 opposing each other, its side face portion is coupled with the coupling portion 5 of the mating element 1, so that a top face 13 of the coupling head 6 opposes the engaging face 12 of the mating element 1.

The first tape nipping portion 3 has expanded portions 17 which are expanded back and forth in the coupling direction, the expanded portion 17 being formed wider than the second tape nipping portion 4. The expanded portion 17 may be formed up to the front end of the first tape nipping portion 3, and the shape and dimension thereof are not restricted to any particular ones. For example, the expanded portion 17 may be formed in a substantially trapezoidal shape as shown in FIG. 1 or may be formed in a substantially triangular shape. Because the expanded portion 17 is formed up to the front end of the first tape nipping portion 3, a front end face 15 of the first tape nipping portion 3 is formed wider in the coupling direction than a front end face 16 of the second tape nipping portion 4.

Figure 9:
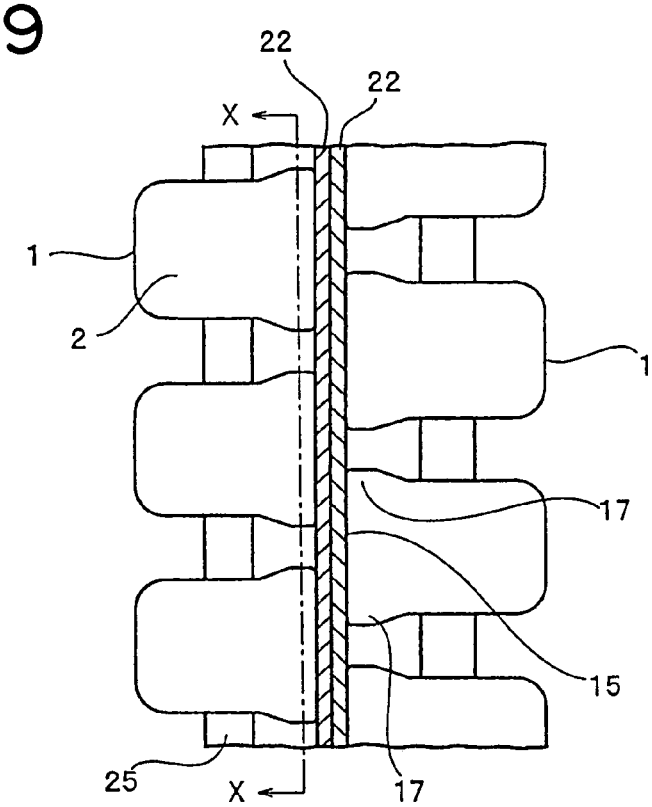
FIG. 9 is a sectional view taken along the line IX-IX of FIG. 8.

In this case, as shown in FIG. 2, the length (width) W1 of the C shaped base portion 2 in the coupling direction is set smaller than the length (width) W2 in the coupling direction of the first tape nipping portion 3 having the expanded portion 17 (that is, W1<W2). By setting the width W1 of the C shaped base portion 2 smaller than the width W2, a predetermined gap (pitch) can be secured between the C shaped base portions 2 of the elements 1 adjoining each other, for example, as shown in FIG. 9 when a concealed type slide fastener 21 is constructed. As a consequence, the core thread portion 25 of the fastener tape 22 is exposed in the gap between the C shaped base portions 2 so that the slide fastener chain is blocked from being stiffened, thereby becoming easy to be bent. Consequently, an operation of bending the slide fastener chain can be carried out easily. The width W1 of the C shaped base portion 2 and the width W2 of the first tape nipping portion 3 having the expanded portions 17 can be set arbitrarily depending on the size or the like of the element 1 itself. Preferably, the width W1 is 2.5 to 2.8 mm, and the width W2 is 3.0 to 3.3 mm.

In the fastener element 1 of this embodiment, a triangular pyramid reinforcing portion 9 is disposed on the top face 13 of the coupling head 6 which intersects with the front end face 16 of the second tape nipping portion 4 at right angle so as to connect the coupling head top face 13 with the front end face 16. In the element 1 of this embodiment, the coupling head 6 is provided via the narrow neck portion 7, and the coupling head top face 13 intersects with the front end face 16 at right angle. For this reason, the strength of the coupling portion 5 is feared. However, the strength of the coupling portion 5 can be secured sufficiently by providing the aforementioned reinforcing portion 9. Thus, even if a strong twisting force or pushing force is applied to the element 1 in an coupled state, the coupling portion 5 is protected from being deformed and damaged.

Figure 8:
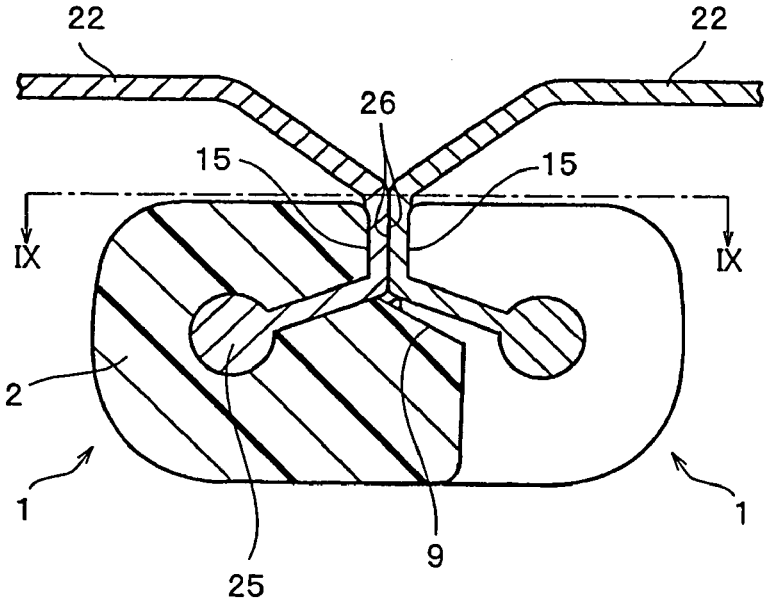
FIG. 8 is a sectional view taken along the line VIII-VIII of FIG. 6.

Further, the reinforcing portion 9 is formed into a triangular pyramid in which the thickness in the vertical direction and the width in the coupling direction decrease gradually as it goes from the front end face 16 of the second tape nipping portion 4 to the front end portion of the coupling head 6. More specifically, when right and left elements 1 attached to the fastener tape 22 are coupled, the reinforcing portion 9 is prevented from making contact with the fastener tape 22 equipped with the mating element 1 as shown in FIG. 8 because the thickness of the reinforcing portion 9 in the vertical direction is decreased gradually. Or, even if it makes contact, the reinforcing portion 9 is prevented from biting into the fastener tape excessively so as to avoid an interference between the reinforcing portion 9 and the fastener tape 22.

By decreasing the width of the reinforcing portion 9 in the coupling direction as it goes toward the front end portion of the coupling head 6, the reinforcing portion 9 is prevented from making contact with the second tape nipping portion 4 of the mating element 1 as shown in FIG. 3A. Further, the reinforcing portion 9 of one element 1 can be prevented from interfering with the second tape nipping portion of the other element 1 when those elements are coupled. As a consequence, a state in which the coupling head top face 13 of the element 1 opposes the engaging face 12 of the mating element 1 can be secured into a stable condition.

If, for example, the dimension of the reinforcing portion 9 is increased in order to intensify the strength of the coupling portion 5, it can be considered that interference between the reinforcing portion 9 and the second tape nipping portion cannot be avoided only if the width of the reinforcing portion 9 in the coupling direction is decreased gradually as it goes toward the front end portion of the coupling head 6. In this case, as shown in FIG. 3B, the shoulder mouth side at the front end of each of both the peak-like edge portions of the second tape nipping portion 4 is provided with a cutout 28 meeting the shape of a reinforcing portion 9' of a mating element 1. As a consequence, interference between the reinforcing portion 9' of one element 1 and the second tape nipping portion 4 of the other element 1 can be avoided securely even if the dimension of the reinforcing portion 9' is increased.

Figure 4:
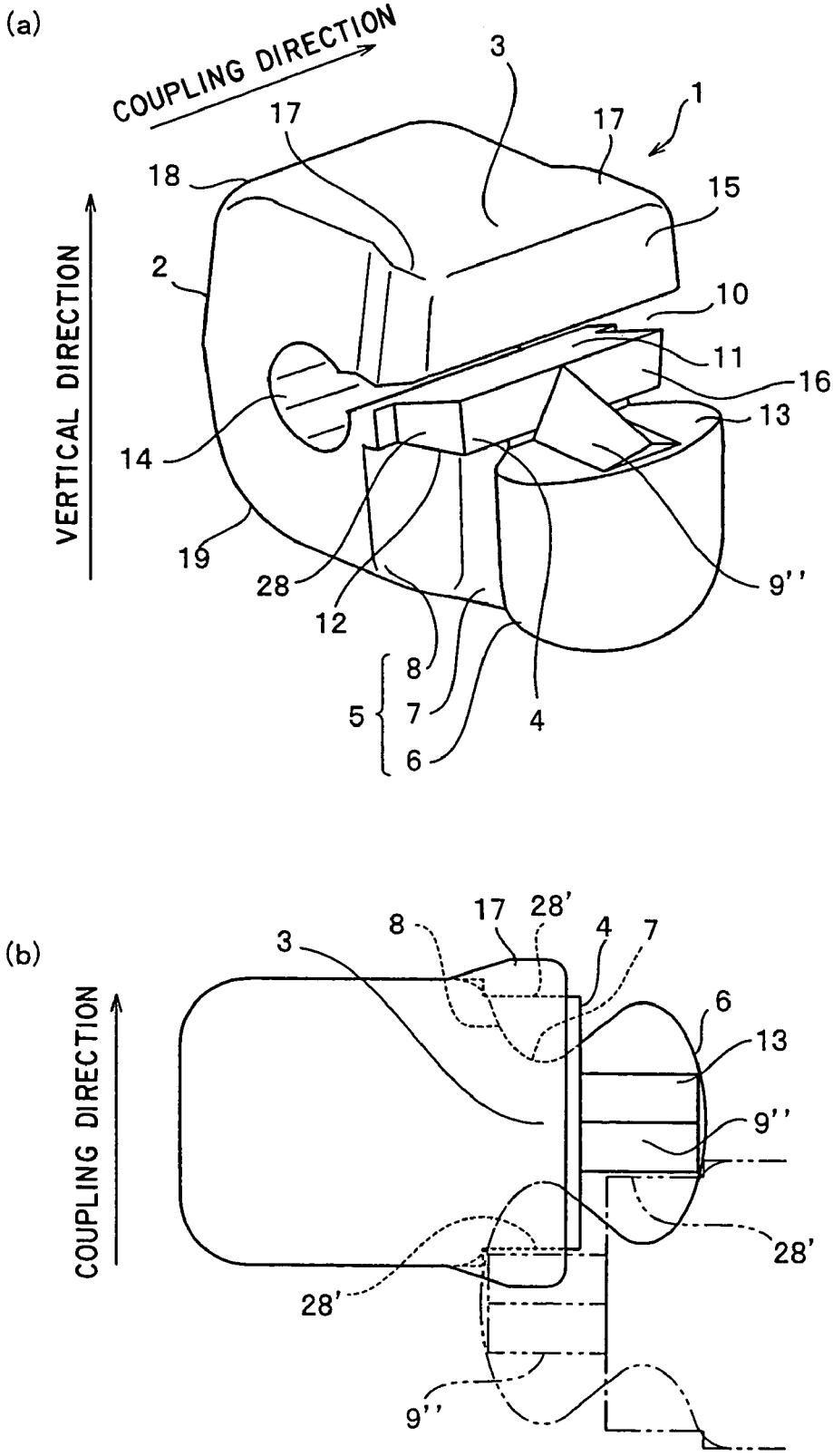
FIG. 4A is a perspective view showing a fastener element according to still another embodiment of the invention.
FIG. 4B is a front view showing a state in which the fastener elements are coupled with each other.

In the present invention, the configuration of the reinforcing portion 9 is not restricted to the triangular pyramid as shown in FIG. 1, but may be constructed conically or in a columnar shape having a rectangular bottom face as shown in FIG. 4A.

For example, if the configuration of a reinforcing portion 9" is columnar as shown in FIG. 4A, the thickness of the reinforcing portion 9" in the vertical direction is decreased gradually as it goes toward the front end portion of the coupling head 6. As a consequence, contact between the reinforcing portion 9" and the mating fastener tape 22 is prevented to avoid interference between the reinforcing portion 9" and the fastener tape 22. In this case, for example, if the width of the reinforcing portion 9" is as large as it does not interfere with the second tape nipping portion 4 of the mating element 1 when elements are coupled with each other, a stable coupled state can be obtained. However, if the width of the reinforcing portion 9" is increased over a certain extent as shown in FIG. 4B, a cutout 28' meeting the shape of the reinforcing portion 9" needs to be provided in the shoulder mouth side at the front end of each of both the peak-like edge portions of the second tape nipping portion 4 in order to avoid the interference between the reinforcing portion 9" of one element 1 and the second tape nipping portion 4 of the other element 1.

Further, in this embodiment, the engaging face 12 which serves as a bottom face of the peak-like second tape nipping portion 4 is tilted with respect to the top face 13 of the coupling head 6 such that the front end side of the engaging face 12 is located at a higher position than a proximal portion thereof. In other words, the engaging face 12 is formed in a tapered face which tilts upward from the proximal portion side to the front end side. Preferably, the engaging face 12 is tilted at an angle of 3° to 7°. Consequently, force for urging the fastener tapes 22 in a direction in which they are fitted to each other can be operated effectively when the elements 1 are coupled, thereby intensifying the concealed property of the concealed type slide fastener 21 effectively.

In the fastener element 1 of this embodiment, a first outer peripheral face 18 of a first bent portion which is bent from the top portion to the side portion of the C shaped base portion 2 and a second outer peripheral face 19 of a second bent portion which is bent from the side portion to the bottom portion form round faces having R shape, respectively. The curvature radius of the second outer peripheral face 19 is set to be formed larger than that of the first outer peripheral face 18. Specifically, preferably, the curvature radius of the first outer peripheral face 18 is R0.5 mm or more and R1.5 mm or less, and the curvature radius of the second outer peripheral face 19 is R1.0 mm or more and R2.0 mm or less, which is a larger value than that of the first outer peripheral face 18.

Figure 5:
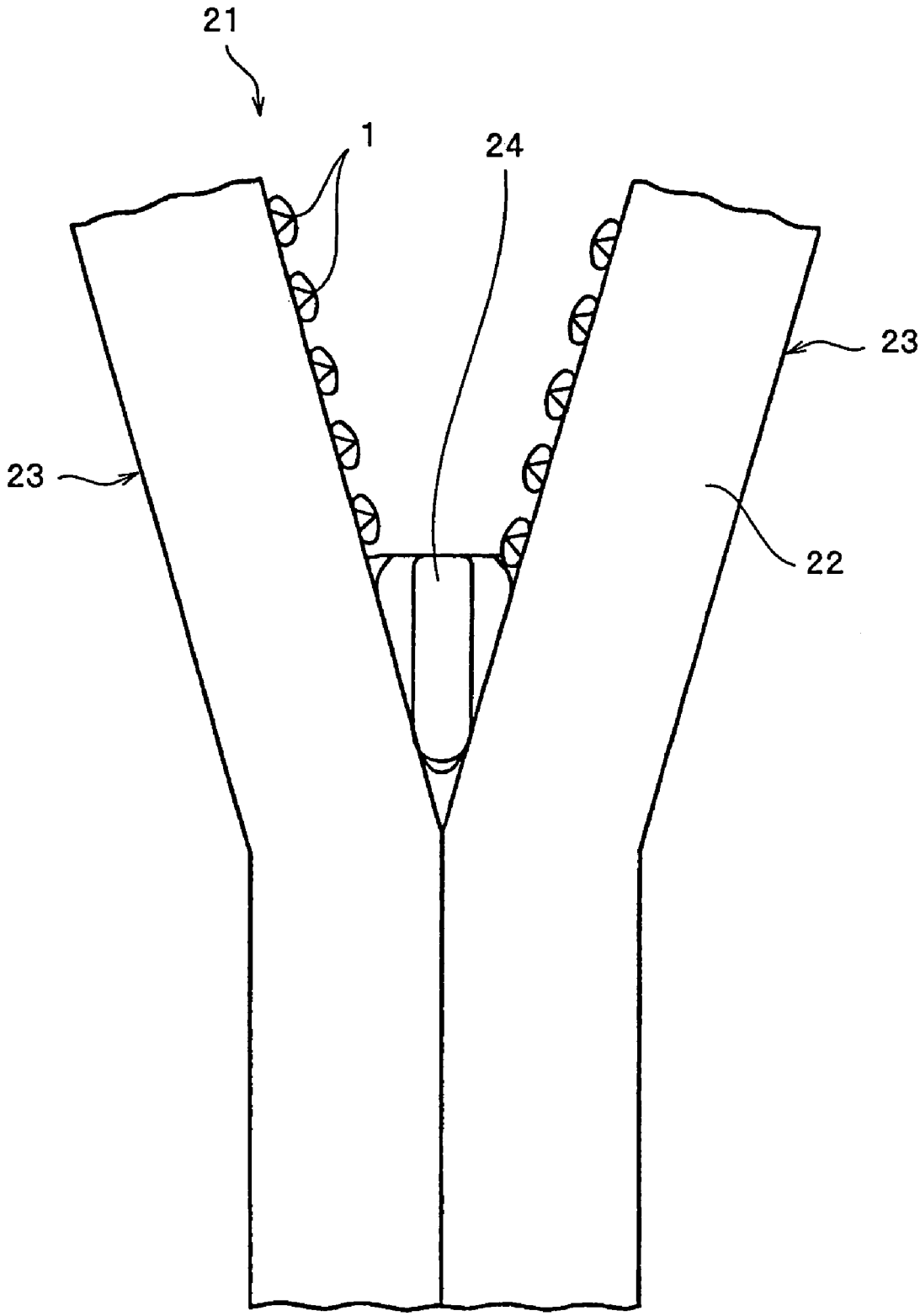
FIG. 5 is a front view of the concealed type slide fastener of the present invention as seen from its tape front surface.
Figure 6:
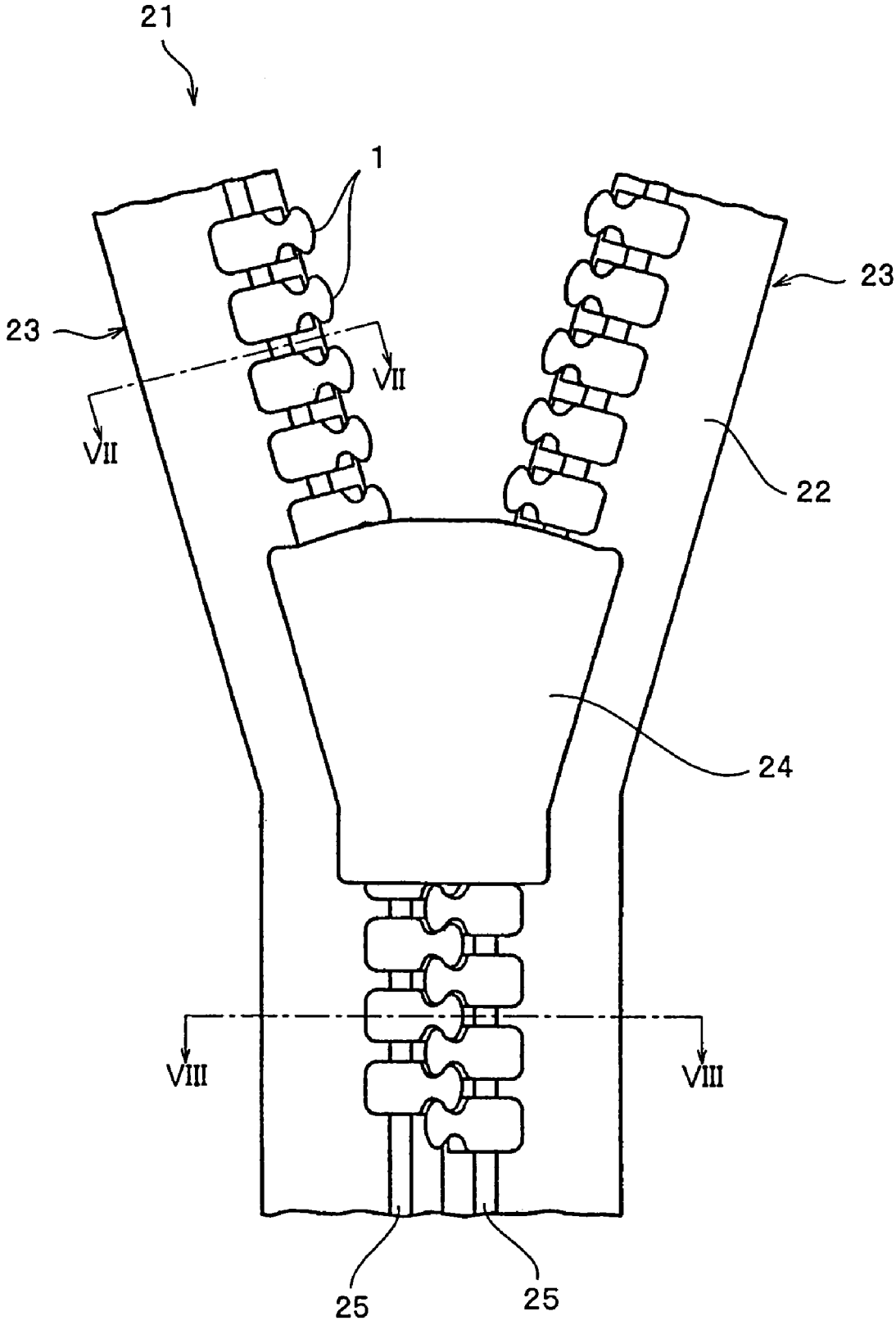
FIG. 6 is a rear view of the concealed type slide fastener as seen from the tape rear side.

Fastener stringers 23 are formed by arranging the above-mentioned fastener elements 1 in line on the element attaching edge portion of each of the pair of fastener tapes 22 at a predetermined interval. Thereafter, a slider 24 is inserted into an element row of the fastener elements 1 with the element attaching edge portion of the fastener tape 22 folded back into a substantially letter U shape, so as to obtain the concealed type slide fastener 21 as shown in FIGS. 5 to 10. FIG. 5 is a front view of the concealed type slide fastener 21 according to the embodiment as seen from the tape front surface side. FIG. 6 is a rear view of the concealed type slide fastener 21 as seen from the tape rear surface side.

Attachment of the fastener elements 1 to the fastener tape 22 can be executed with conventionally used means. For example, the elements 1 of synthetic resin having a specified configuration can be mounted to the fastener tape 22 by injection molding synthetic resin to the element attaching edge portion of the fastener tape 22. In this case, examples of the synthetic resin which is used as a material of the element 1 include polyacetal, polybutylene terephthalate, and nylon. The element 1 made of metal can be mounted onto the fastener tape 22 by die-casting copper alloy, nickel alloy, aluminum or the like.

Figure 7:
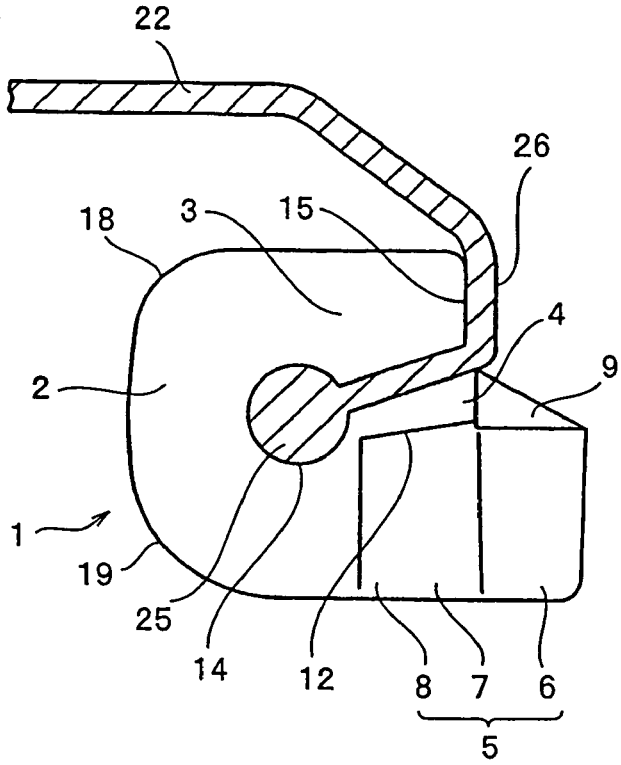
FIG. 7 is a sectional view taken along the line VII-VII of FIG. 6.

In the concealed type slide fastener 21 obtained by using the fastener element 1, as shown in FIG. 7, the core thread portion 25 of the fastener tape 22 is held by the circular holding groove 14 of the element 1, and the element attaching edge portion of the fastener tape 22 is nipped by the first tape nipping portion 3 and the second tape nipping portion 4 of the element 1.

The fastener tape 22 is folded back at the front end of the first tape nipping portion 3 into a substantially letter U shape. The elements 1 attached to the right and left fastener tapes 22 are coupled by sliding the slider 24, whereby folded back end faces 26 which are folded back into a substantially letter U shape of the fastener tape 22 are fitted to each other as shown in FIG. 8. As a consequence, the concealed type slide fastener 21 can keep the coupled elements 1 from being seen from the front surface side of the fastener tape 22.

Figure 11:
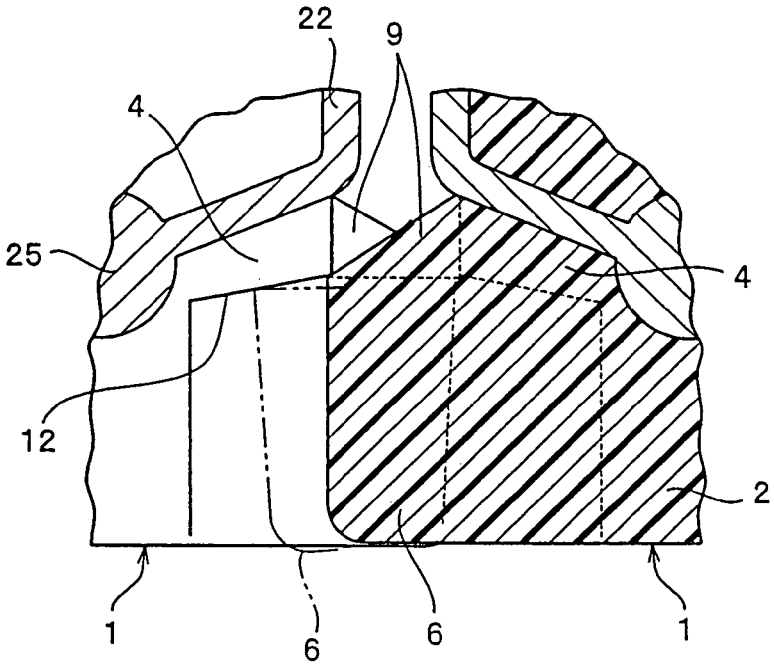
FIG. 11 is an explanatory view for explaining a sliding of a coupling head when the fastener elements are coupled with each other.

At this time, the engaging face 12 of the second tape nipping portion 4 of the element 1 is tilted in a tapered shape with respect to the top face 13 of the coupling head 6 as described above. Thus, when coupling the coupling portions 5 of the right and left elements 1 as shown in FIG. 11, the coupling head 6 of one element 1 slides up to an coupling position while guided such that the coupling head 6 is pushed down by the engaging face 12 of a mating element.

As a consequence, when the elements 1 are coupled, force of urging the fastener tapes 2 in the direction in which they are fitted to each other can be applied. Accordingly, even if right and left fastener tapes 22 receive pulling stress when the elements 1 are coupled, the right and left elements 1 are blocked from being opened upward by the force applied in the fitting direction, so that the right and left fastener tapes 22 can be fitted to each other stably through the folded back end faces 26. Therefore, generation of a gap between the tapes 22 is prevented, thereby intensifying the concealed property of the concealed type slide fastener.

The coupling head 6 of each of the right and left elements 1 slides on the engaging face 12 because the engaging face 12 is of tapered face, so that the coupling portions 5 can be coupled with each other smoothly and securely. Consequently, the sliding motion of the slider is smoothed to improve the sliding performance thereof.

In the concealed type slide fastener 21 of this embodiment, the first tape nipping portion 3 of the element 1 has the expanded portion 17, and the front end face 15 is formed wider than the front end face 16 of the second tape nipping portion 4. As a consequence, when the right and left elements 1 are coupled as shown in FIG. 9, the front end face 15 of the first tape nipping portion 3 can increase an area for pressing the fastener tape 22 from the right and left as compared to the conventional type, so that the fastener tape 22 can be pressed stably from both sides between the right and left elements 1. Consequently, when the concealed type slide fastener 21 receives the pulling stress, generation of a gap between the right and left fastener tapes 22 can be prevented effectively, thereby securing the excellent concealed property of the concealed type slide fastener 21.

Figure 10:
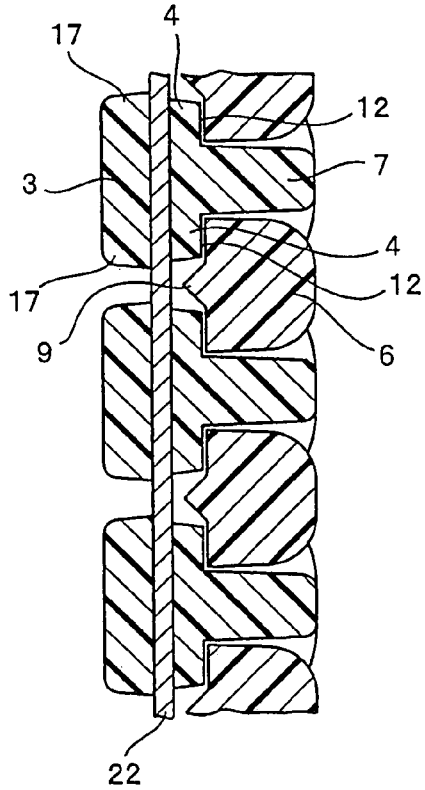
FIG. 10 is a sectional view taken along the line X-X of FIG. 9.

When the right and left elements 1 are coupled, the coupling head 6 of one element 1 opposes the engaging face 12 of the other element 1 as shown in FIG. 10. When the concealed type slide fastener 21 receives the twisting force or the pushing force in this state, the second tape nipping portion 4 is pressed by the coupling head 6 of the mating element from the engaging face 12 side. The conventional concealed type slide fastener has such a problem that the element is easy to be deformed or damaged because large force is applied to a portion of the element making contact with the coupling head if such the twisting force or the pushing force is applied when the elements are coupled.

However, in the concealed type slide fastener 21 of this embodiment, the wide first tape nipping portion 3 having the expanded portions 17 opposes the second tape nipping portion 4 so as to sandwich the fastener tape 22, and further, the interval between the respective elements 1 in the coupling direction is narrowed by existence of the expanded portion 17. Thus, even if the second tape nipping portion 4 receives a load when the twisting force or the pushing force is applied to the concealed type slide fastener 21, the widely formed first tape nipping portion 3 can support the second tape nipping portion 4 via the tape 22 so as to prevent generation of deformation or damage in the second tape nipping portion 4.

Moreover, in the concealed type slide fastener 21 of this embodiment the reinforcing portion 9 is provided so as to connect the front end face 16 of the second tape nipping portion 4 with the top face 13 of the coupling head 6 intersecting therewith at right angle. Consequently, the strength of the coupling portion is secured sufficiently so as to prevent the coupling portion from being deformed or damaged. For this reason, even if the elements in coupling condition receive strong twisting force, pushing force or the like, the fit state of the fastener tapes 22 fitted between the right and left elements is maintained stably, thereby raising the concealed property of the concealed type slide fastener largely.

As described above, the concealed type slide fastener 21 of this embodiment can secure an excellent concealed property even if it is attached to an automobile seat cover likely to receive the pulling stress by means of three actions, that is, an action of improving the concealed property by forming the engaging face 12 of the second tape nipping portion 4 into a tapered face; an action of improving the concealed property by forming the front end face 15 of the first tape nipping portion 3 to be wide with the expanded portions 17; and an action of improving the concealed property with the reinforcing portion 9.

Although this embodiment intends to improve the concealed property by tilting of the engaging face 12, formation of the expanded portions 17, and formation of the reinforcing portion 9 as described above, the present invention is not restricted to this example. Even if only any one of those components is provided, the concealed property of the concealed type slide fastener can be improved largely.

The concealed type slide fastener 21 can prevent the coupling portion 5 from being deformed or damaged even if it receives the twisting force or the pushing force because the expanded portions 17 is formed in the first tape nipping portion 3. Besides, the strength of the coupling portion 5 is intensified by providing the coupling head top face 13 with the reinforcing portion 9. Accordingly, the concealed type slide fastener 21 of this embodiment is a high quality concealed type slide fastener capable of bearing a long-term use.

Further, this concealed type slide fastener 21 can obtain an excellent sliding characteristic by suppressing an interference between the element 1 and the slider 24 when the slider 24 is slid because the first outer peripheral face 18 and the second outer peripheral face 19 of the element 1 are of curved surface having R shape. Additionally, the following advantages can be obtained.

Figure 12:
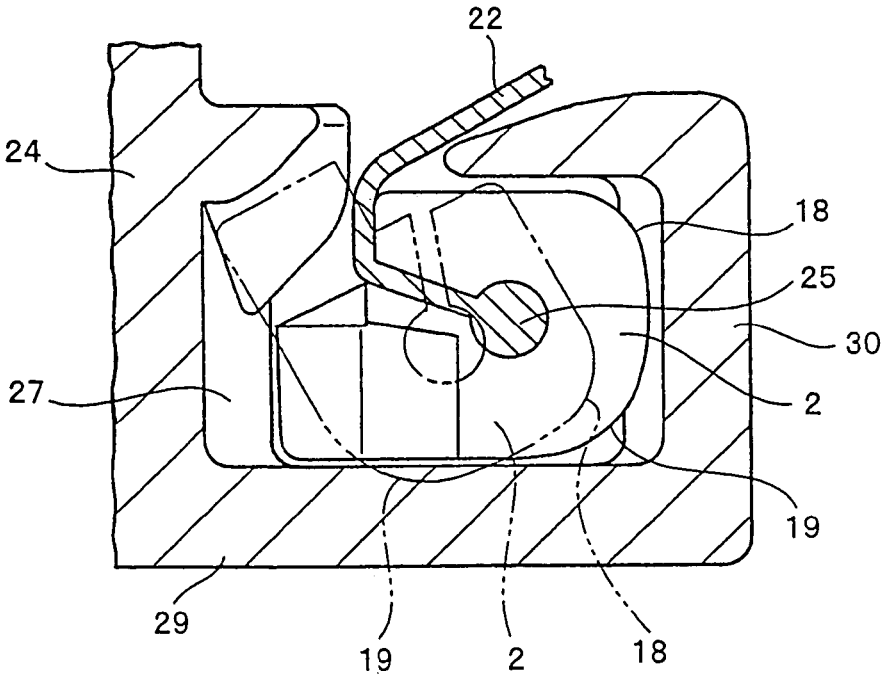
FIG. 12 is an explanatory view for explaining changes of the posture of the fastener element when the fastener element is guided into an element passage in the slider.

For example, if the pulling stress is applied to the right and left fastener elements 22 outwardly when the right and left elements 1 are coupled by sliding the slider 24, the element 1 may advance into the element passage 27 of the slider 24 in a tilted posture as indicated by dotted line in the FIG. 12.

In this case, when the element 1 passes through the element passage 27 in the slider 24, the second outer peripheral face 19 of the element 1 makes contact with a bottom plate 29 of the slider 24 and the first outer peripheral face 18 makes contact with an inverted L shaped flange 30 of the slider 24, so that it slides toward the rear mouth side of the slider 24. At that time, depending on the configuration inside of the element passage 27 of the slider 24, the element 1 can be rotated within the element passage 27 by bringing the second outer peripheral face 19 into contact with the bottom plate 29 of the slider 24 and the first outer peripheral face 18 into contact with the flange 30 of the slider 24 so as to tilt the posture of the element 1 into a posture suitable for coupling as indicated with solid line in FIG. 12.

Even if the element 1 advances into the element passage 27 in the slider 24 in an inappropriate posture such that it is tilted with respect to the element passage 27, the concealed type slide fastener 21 of this embodiment can obtain such an advantage that it can secure a stable coupled state by tilting the posture of the element 1 within the element passage 27 so as to couple the right and left elements 1 securely.

Particularly, according to this embodiment, the second outer peripheral face 19 of the element 1 has a larger curvature radius than that of the first outer peripheral face 18 as described above. That is, when the element 1 is tilted to a posture suitable for coupling by rotating it within the slider 24 as described above, the second outer peripheral face 19 has a larger area for contacting with the slider than the first outer peripheral face 18. Thus, because the second outer peripheral face 19 has a larger curvature radius than the first outer peripheral face 18, the element 1 can be tilted efficiently and stably because the element is rotated smoothly within the element passage 27.

The fastener element of the present invention can be applied effectively as a fastener element for a concealed type slide fastener which is mounted on an automobile seat cover, clothes or the like, and demanded to have a concealed property and coupling strength.

What is claimed is:

1. A fastener element for a concealed slide fastener having a substantially U shaped section including a side edge portion mounting groove for a fastener tape, comprising:

a C shaped base portion for holding a core thread portion; first and second tape nipping portions which are flat and extended substantially in parallel from respective front ends of the C shaped base portion; and a coupling portion integrated with an engaging face side on an opposite side to a tape nipping face of the second tape nipping portion, wherein the first tape nipping portion has expanded portions which are expanded back and forth in a coupling direction, and a front end face of the first tape nipping portion is formed wider than a front end face of the second tape nipping portion.

2. A fastener element for a concealed slide fastener having a substantially U shaped section including a side edge portion mounting groove for a fastener tape, comprising:

a C shaped base portion having a circular holding groove for holding a core thread portion; first and second tape nipping portions which are flat and extended substantially in parallel from respective front ends of the C shaped base portion; and a coupling portion integrated with an engaging face which is a rear face on an opposite side to a tape nipping face of the second tape nipping portion, wherein the engaging face of the second tape nipping portion is formed in a tapered face which is tilted upward from a proximal portion on the circular holding groove side of the engaging face toward a front end on a coupling head side thereof with respect to a top face of the coupling head of the coupling portion.

3. A fastener element for a concealed slide fastener having a substantially U shaped section including a side edge portion mounting groove for a fastener tape, comprising:

a C shaped base portion for holding a core thread portion; first and second tape nipping portions which are flat and extended substantially in parallel from respective front ends of the C shaped base portion; and a coupling portion integrated with an engaging face side on a opposite side to a tape nipping face of the second tape nipping portion, wherein a first outer peripheral face of a first bent portion is bent from an upper portion to a side portion of the C shaped base portion and a second outer peripheral face of a second bent portion is bent from the side portion to a lower portion to form a curved surface, and the second outer peripheral face has a larger curvature radius than that of the first outer peripheral face;

a reinforcing portion for connecting a front end face of the second tape nipping portion with a top face of a coupling head of the coupling portion.

4. The fastener element according to claim 3, wherein a thickness of the reinforcing portion in a vertical direction decreases gradually as it goes from the front end face of the second tape nipping portion to a front end portion of the coupling head.

5. The fastener element according to claim 3, wherein a width of the reinforcing portion decreases in a coupling direction gradually from the front end face of the second tape nipping portion to a front end portion of the coupling head.

6. A concealed slide fastener, wherein a plurality of fastener elements according to any one of claims 1 to 3 are arranged in line at a predetermined interval along element attaching edge portions of a pair of fastener tapes, and a slider is inserted into the fastener elements with each of the fastener tapes on an element attaching edge portion side folded back into a substantially letter U shape.

7. The fastener element according to claim 3, wherein the second tape nipping portion has a cutout in a shoulder mouth side at a front end of each of both edge portions back and forth in a coupling direction.

* * * * *